US008547310B2

(12) United States Patent
Kim

(10) Patent No.: US 8,547,310 B2
(45) Date of Patent: Oct. 1, 2013

(54) LIQUID CRYSTAL DISPLAY DEVICE AND METHOD FOR SELECTING OVERDRIVING WHEN THE PIXEL DATA IS MOTION IMAGE DATA

(75) Inventor: Ki Duk Kim, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 934 days.

(21) Appl. No.: 11/966,637

(22) Filed: Dec. 28, 2007

(65) Prior Publication Data

US 2008/0211752 A1 Sep. 4, 2008

(30) Foreign Application Priority Data

Dec. 29, 2006 (KR) ..... 10-2006-0138546

(51) Int. Cl.
*G09G 3/36* (2006.01)

(52) U.S. Cl.
USPC ..... 345/87; 345/690

(58) Field of Classification Search
USPC ..... 345/87–107, 204, 690–691, 210–215; 382/236, 107, 232
See application file for complete search history.

(56) References Cited

U.S. PATENT DOCUMENTS 5,546,104 A * 8/1996 Kuga ..... 345/99
5,586,202 A 12/1996 Ohki et al.
5,909,402 A * 6/1999 Joo ..... 365/189.07
7,639,228 B2 12/2009 Nagata
2003/0011709 A1 1/2003 Kasahara et al.
2005/0237316 A1 10/2005 Huang et al.
2005/0253833 A1* 11/2005 Teshirogi et al. ..... 345/204
2006/0152463 A1 7/2006 Furihata et al.
2006/0152501 A1* 7/2006 Furihata et al. ..... 345/204
2008/0001872 A1* 1/2008 Abe ..... 345/87
2010/0079473 A1* 4/2010 Choi et al. ..... 345/545

FOREIGN PATENT DOCUMENTS

CN 1192614 C 3/2005
CN 1697011 A 11/2005
CN 1804989 A 7/2006
EP 1 494 169 A2 1/2005
EP 1596353 A2 11/2005
JP 2005-43864 A 2/2005
JP 2005-241817 A 9/2005
JP 2006-133384 A 5/2006
JP 2006-189663 A 7/2006

* cited by examiner

*Primary Examiner* — Liliana Cerullo
(74) *Attorney, Agent, or Firm* — Birch, Stewart, Kolasch & Birch, LLP

(57) ABSTRACT

Provided are a liquid crystal display device capable of improving motion image quality and a method for driving the same. The liquid crystal display device according to an embodiment of the present invention includes an input unit, an overdriving compensation unit, a selection unit, and a data selection control unit. The input unit supplies pixel data to a pixel of a liquid crystal panel. The overdriving compensation unit outputs overdriving compensation pixel data using the pixel data input from the input unit. The selection unit selects one of the pixel data input from the input unit and the overdriving compensation data input from the overdriving compensation unit. The data selection control unit detects whether the pixel data input from the input unit is motion image data to control the selection unit.

4 Claims, 2 Drawing Sheets

LIQUID CRYSTAL DISPLAY DEVICE AND METHOD FOR SELECTING OVERDRIVING WHEN THE PIXEL DATA IS MOTION IMAGE DATA

CROSS-REFERENCE TO RELATED APPLICATIONS

The present application claims priority under 35 U.S.C. 119 and 35 U.S.C. 365 to Korean Patent Application No. 10-2006-0138546 filed on Dec. 29, 2006, which is hereby incorporated by reference in its entirety.

BACKGROUND

The present disclosure relates to a liquid crystal display (LCD) device, and more particularly, to a liquid crystal display device capable of improving motion image quality and a method for driving the same.

A liquid crystal display device includes a liquid crystal panel for displaying images and a driving unit for applying driving signals to the liquid crystal panel. Though not shown, the liquid crystal panel includes two substrates and a liquid crystal layer disposed between the substrates. The two substrates are attached to each other with a predetermined cell gap.

A still image is displayed on the liquid crystal panel using a single frame. A motion image is obtained by displaying a plurality of still images on the liquid crystal panel sequentially. The motion image is formed of a plurality of frames, and the liquid crystal layer is continuously driven according to the volume of data signals corresponding to the frames. The volume of the data signal corresponding to each frame is expressed as the level of a gray scale voltage in the liquid crystal layer, which changes molecular arrangement of a liquid crystal in the liquid crystal layer. Since liquid crystal molecules have dielectric anisotropy, dielectric constants of the liquid crystal molecules change according to long axis directions of the liquid crystal molecules. The gray scale voltage of the liquid crystal layer changes according to the dielectric constant. The change of the gray scale voltage significantly reduces response time of the liquid crystal molecules in the liquid crystal layer.

In other words, when a gray scale voltage of a current frame data signal, which is greater than a gray scale voltage of a previous frame data signal, is applied to the liquid crystal, the gray scale voltage of the current frame data signal does not arrive at a desired gray scale voltage immediately because the gray scale voltage of the current frame data signal is affected by the gray scale voltage of previous frame data signal. After several frames pass, the gray scale voltage of the current frame data signal arrives at the desired gray scale voltage. This phenomenon may cause image-sticking, which means that an image of a second frame is overlapped with that of a first frame on the liquid crystal panel. Recently, researches are carried out to improve the response time of the liquid crystal molecules using overdriving compensation data, which has a value greater than a normal value of data corresponding to a signal setting the gray scale voltage.

FIG. 1 is a view illustrating a related art liquid crystal display device including an overdriving circuit.

Referring to FIG. 1, the related art liquid crystal display device includes: a liquid crystal panel 2 for displaying predetermined images; a data driver 6 and a gate driver 4 for driving the liquid crystal panel 2; and a timing controller 8 for controlling the drivers 4 and 6. The related art liquid crystal display device including the overdriving circuit will now be described briefly.

The related art liquid crystal display device further includes an ODC driving unit 10 for modulating input data supplied from an external system into overdriving compensation data to be supplied to the data driver 6.

The over driving circuit (ODC) driving unit 10 includes a frame memory 12 and a lookup table 14. The frame memory 12 delays the input data by one frame to output delayed data. Overdriving compensation data is output using the lookup table 14 according to rates corresponding to the input data and the delayed data.

The lookup table 14 is formed by arranging the input data along X-axis; arranging the delayed data along Y-axis; and inputting the overdriving compensation data at an intersection point of X-axis and Y-axis. The input data and the delayed data are input to the lookup table 14, and then the lookup table 14 outputs the overdriving compensation data corresponding to an intersection point of the input data and the delayed data to the data driver 6. The data driver 6 converts the overdriving compensation data into analog voltages to be applied to the liquid crystal panel 2. A gray scale voltage of a liquid crystal disposed in the liquid crystal panel 2 is increased using the overdriving compensation data.

As such, the ODC driving unit 10 outputs the overdriving compensation data to be applied to the liquid crystal panel 2. The ODC driving unit 10 outputs the overdriving compensation data according to the rates corresponding to change of a gray scale. When a fast motion image is displayed on the liquid crystal panel 2, the sharpness of the motion image is deteriorated by slow response time of the liquid crystal panel 2. In here, the ODC driving unit 10 prevents the deterioration of the sharpness. On the contrary, in the case where the ODC driving unit 10 is applied to still images, the sharpness of the still images is deteriorated.

Furthermore, the still images do not need the ODC driving unit 10, the application of the ODC driving unit 10 to the still images increases power consumption unnecessarily.

SUMMARY

Accordingly, the present disclosure is directed to a liquid crystal display device that substantially obviates one or more of the problems due to limitations and disadvantages of the related art.

Embodiments provide a liquid crystal display device capable of improving motion image quality and a method for driving the same.

Embodiments also provide a liquid crystal display device capable of reducing power consumption and a method for driving the same.

In one embodiment, a liquid crystal display device includes an input unit for supplying pixel data to a pixel of a liquid crystal panel; an overdriving compensation unit outputting overdriving compensation pixel data using the pixel data input from the input unit; a selection unit selecting one of the pixel data input from the input unit and the overdriving compensation data input from the overdriving compensation unit; and a data selection control unit detecting whether the pixel data input from the input unit is motion image data to control the selection unit.

In another embodiment, a method for driving a liquid crystal display device includes inputting pixel data; outputting overdriving compensation data using the input pixel data; detecting whether the input pixel data is motion image data to select one of the input pixel data and the overdriving compensation pixel data according to a result of the detection; and displaying an image corresponding to the selected pixel data.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) and together with the description serve to explain the principle of the disclosure.

DETAILED DESCRIPTION OF THE EMBODIMENTS

Reference will now be made in detail to the embodiments of the present invention, examples of which are illustrated in the accompanying drawings.

Figure 2:
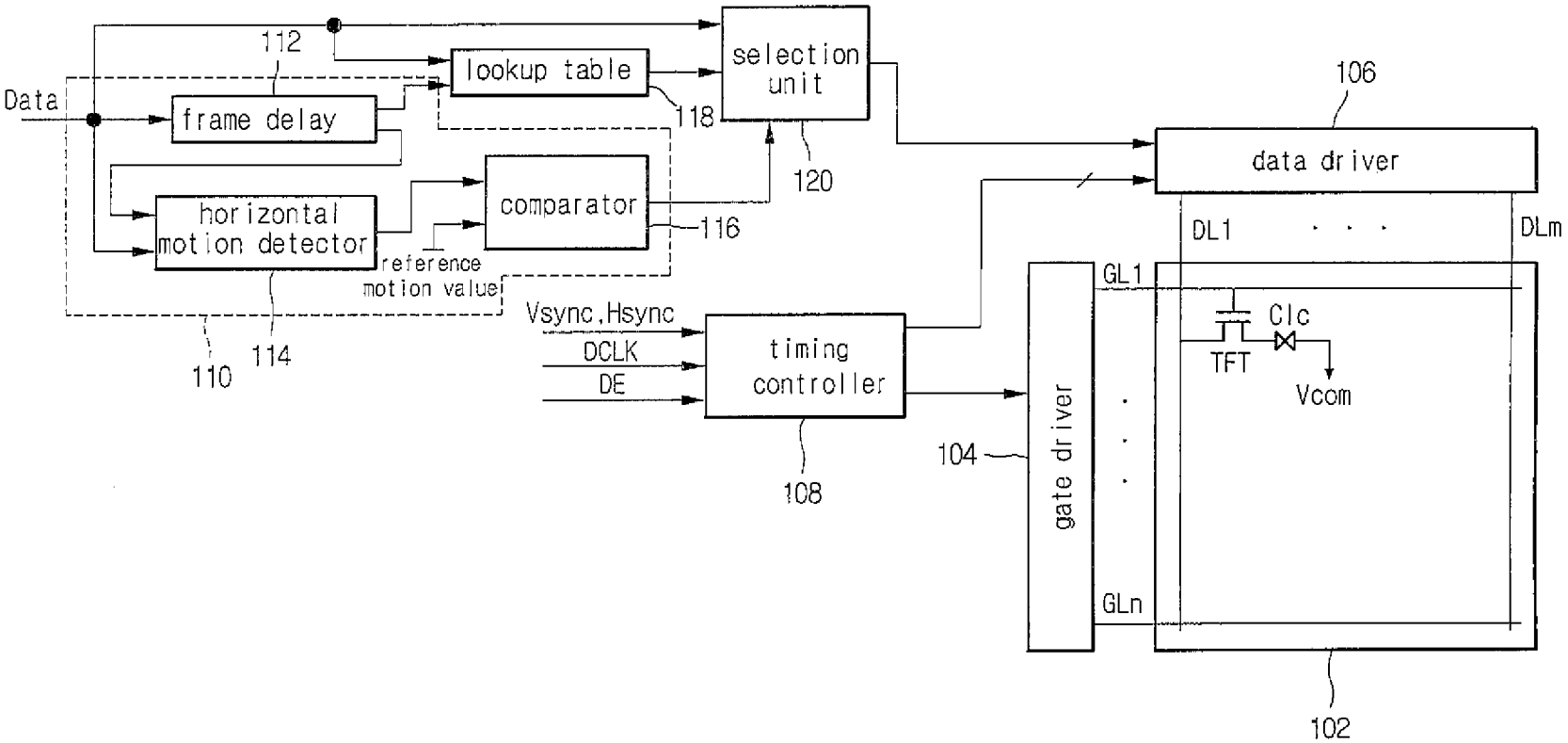
FIG. 2 is a view illustrating a liquid crystal display device according to an embodiment.

FIG. 2 is a view illustrating a liquid crystal display device according to an embodiment.

Referring to FIG. 2, the liquid crystal display device includes a liquid crystal panel 102, a gate driver 104, a data driver 106, and a timing controller. The liquid crystal panel 102 displays images. The gate driver 104 drives a plurality of gate lines GL1 to GLn on the liquid crystal panel 102. The data driver 106 drives a plurality of data lines DL1 to DLn on the liquid crystal panel 102. The timing controller controls driving timings of the gate driver 104 and the data driver 106.

The liquid crystal display further includes a lookup table 118, a selection unit 120, and a data selection control unit 110. An external system (not shown) supplies input data to the lookup table 118. The lookup table 118 outputs overdriving compensation data according to different rates. The selection unit 120 selectively outputs the input data from the external system and the overdriving compensation data to the data driver 106. The data selection control unit 110 generates a data selection control signal used to select one of the input data and the overdriving compensation data.

The liquid crystal panel 102 includes pixels disposed in portions defined by the gate lines GL1 to GLn and the data lines DL1 to DLn. Each of the pixels includes a thin film transistor TFT and a liquid crystal cell Clc. The thin film transistor TFT is disposed at an intersection region of a corresponding gate line CL1 and a corresponding date line DL1. The liquid crystal cell Clc is connected between the thin film transistor TFT and an electrode of a common voltage Vcom.

The thin film transistor TFT is responsive to a gate scan signal applied to the corresponding gate line GL1 to switch a data voltage supplied from the data line DL1 to the liquid crystal cell Clc. The liquid crystal cell Clc includes a common electrode (not shown) r a pixel electrode (not shown) connected to the thin film transistor TFT, and a liquid crystal layer (not shown) disposed between the common electrode and the pixel electrode. The liquid crystal cell Clc is charged with a pixel data voltage supplied through the thin film transistor TFT, and the charged pixel data voltage is maintained until the thin film transistor TFT is turned on again.

The pixel of the liquid crystal panel 102 includes a storage capacitor (not shown) connected between the thin film transistor TFT and a previous gate line (not shown). The storage capacitor minimizes a reduction of the charged pixel data voltage.

The gate driver 104 is responsive to gate control signals (GCSs) generated from the timing controller 108 to supply gate scan signals to the corresponding gate lines GL1 to GLn, respectively. The gate lines GL1 to GLn are sequentially enabled by the gate scan signals in each period of one horizontal sync signal.

The data driver 106 is responsive to data control signals (DCSs) generated from the timing controller 108 to supply pixel data voltages to the data lines DL1 to DLn, respectively, whenever any one of the data lines DL1 to DLn is enabled. The data driver 106 converts input pixel data corresponding to the amount of one line into analog pixel data voltages using a gamma voltage set.

The timing controller 108 generates the gate control signals (GCSs), the data control signals (DCSs), and a polarity reverse signal (POL), by using a data clock DCLK, a horizontal sync signal Hsync, a vertical sync signal Vsync, and a data enable signal DE, which are generated from the external system (e.g., a graphic card of a computer system or a TV signal decoder module of a television receiver). The gate control signals (GCSs) are supplied to the gate driver 104. The data control signals (DCSs) and the polarity reverse signal (POL) are supplied to the data driver 106.

The data selection control unit 110 includes a frame delay 112, a horizontal motion detector 114, and a comparator 116. The frame delay 112 delays data input from the external system during a current frame by one frame. The horizontal motion detector 114 detects an X-axis direction motion value of an image using the input data and the delayed data. The comparator 116 compares the detected X-axis direction motion value with a reference motion value to generate the data selection control signal according to a result of the comparison.

The components of the data selection control unit 110 will now be described in detail.

Figure 1:
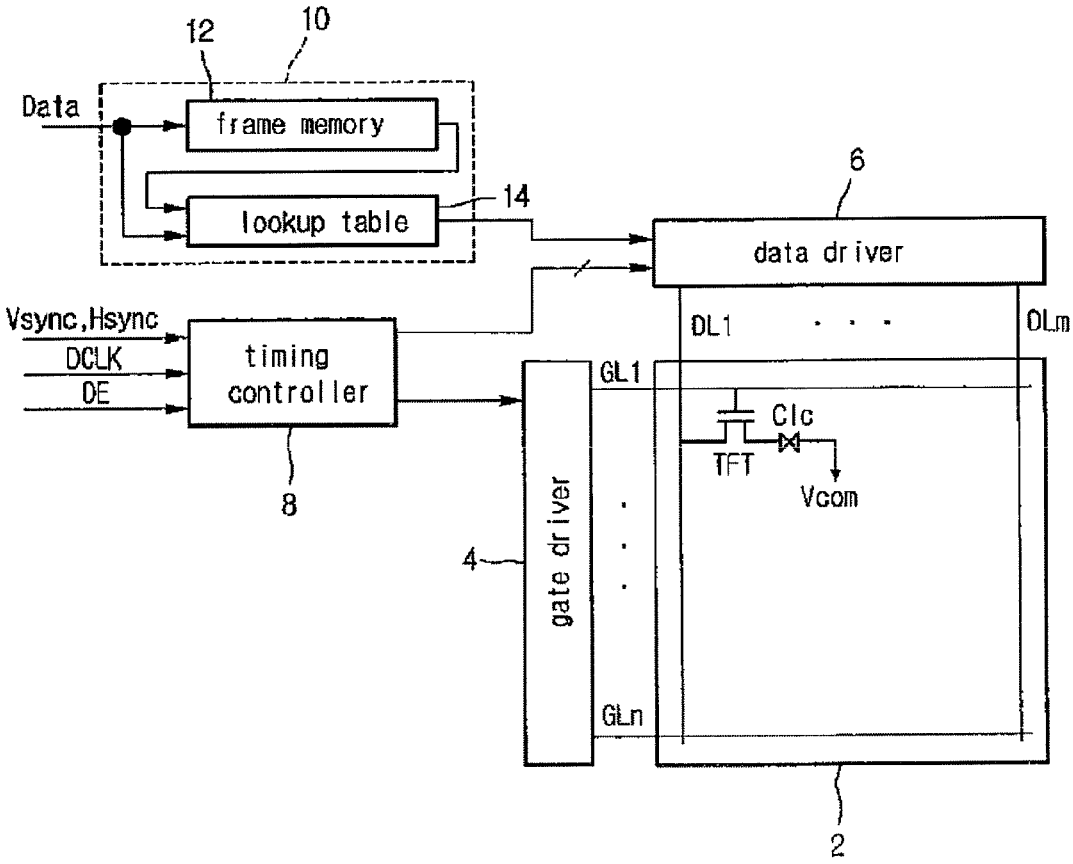
PRIOR ART FIG. 1
FIG. 1 is a view illustrating a related art liquid crystal display device including an overdriving circuit.

The frame delay 112 serves as the frame memory 12 illustrated in FIG. 1. The frame delay 112 also outputs the delayed data to the horizontal motion detector 114.

The horizontal motion detector 114 detects and calculates an X-axis direction motion value of an image corresponding to the input data and the delayed data. That is, the horizontal motion detector 114 calculates the number of X-axis direction motion pixels. The horizontal motion detector 114 supplies the calculated x-axis direction motion value to the comparator 116.

The comparator 116 compares the calculated X-axis direction motion value with the reference motion value that is preset. For example, if the reference motion value corresponds to four pixels, the comparator 116 generates a data selection control signal corresponding to the calculated X-axis direction motion value having four pixels or more or the calculated X-axis direction motion value less than four pixels.

If the calculated X-axis direction motion value is the same as or greater than the reference motion value, the comparator 116 generates a first logic (e.g., high) data selection control signal. If the calculated X-axis direction motion value is less than the reference motion value, the comparator 116 generates a second logic (e.g., low) data selection control signal. The first or second logic data selection control signal is supplied to the selection unit 120.

The lookup table 118 is the same as the lookup table 14 illustrated in FIG. 1. The lookup table 118 is formed by arranging the input data supplied from the external system along X-axis; arranging the delayed data along Y-axis; and inputting the overdriving compensation data at an intersection point of x-axis and y-axis. After all, when the input data from the external system and the delayed data are supplied to the lookup table 118, the lookup table 118 outputs the overdriving compensation data corresponding to the intersection point of the input data and the delayed input data to the selection unit 120.

The input data from the external system and the overdriving compensation data are supplied to the selection unit 120. As described above, the first or second logic data selection control signal generated by the data selection control unit 110 is also supplied to the selection unit 120.

The selection unit 120 outputs one of the overdriving compensation data and the input data supplied from the external system to the data driver 106 according to the first and second logic data selection control signals.

If the first logic data selection control signal is supplied to the selection unit 120, the selection unit 120 selects the overdriving compensation data to output the overdriving compensation data to the data driver 106. The data driver 106 converts the overdriving compensation data into analog data voltages to be supplied to the liquid crystal panel 102. The liquid crystal panel 102 overdrives a liquid crystal therein using the analog data voltages.

For the selection unit 120 to output the overdriving compensation data to the data driver 106 means that the input data supplied from the external system during the current frame corresponds to a fast motion image. That is, since the input data supplied form the external system during the current frame corresponds to the fast motion image compared with the reference motion value, the selection unit 120 outputs the overdriving compensation data to the data driver 106 for driving the liquid crystal panel 102.

If the second logic data selection control signal is supplied to the selection unit 120, the selection unit 120 selects and outputs the input data supplied from the external system to the data driver 106. The data driver 106 converts the input data supplied from the external system into analog data voltages to be supplied to the liquid crystal panel 102. The liquid crystal panel 102 overdrives the liquid crystal therein using the analog data voltages.

For the selection unit 120 to output the input data supplied from the external system to the data driver 106 means that the input data supplied from the external system during the current frame corresponds to a slow motion image. That is, since the input data supplied from the external system during the current frame corresponds to the slow motion image compared with the reference motion value, the selection unit 120 outputs the input data supplied from the external system to the data driver 106 for driving the liquid crystal panel 102.

As such, it is determined whether the overdriving of the liquid crystal panel 102 is performed according to the calculated X-axis direction motion value corresponding to the input data supplied from the external system compared with the reference motion value. While the overdriving is not performed for slow motion images, the overdriving is performed for fast motion images, thereby preventing deterioration in image quality.

As discussed above, the liquid crystal display device of the present disclosure detects the speed of input images so as to determine whether the overdriving is performed according to the speed of the input images, thereby improving the image quality, unlike related art liquid crystal display devices that overdrive liquid crystal panels regardless of the speed of input images, thereby causing deterioration in image sharpness.

Furthermore, the liquid crystal display device of the present disclosure is capable of reducing power consumption because of the selective overdriving depending on the speed of images.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device comprising:

an input unit for supplying pixel data to a pixel of a liquid crystal panel;

an overdriving compensation unit outputting overdriving compensation pixel data using the pixel data input from the input unit;

a selection unit selecting one of the pixel data input from the input unit and the overdriving compensation data input from the overdriving compensation unit; and a data selection control unit detecting whether the pixel data input from the input unit is motion image data to control the selection unit, wherein the data selection control unit comprises:

a frame delay configured to delay the pixel data input from the input unit by one frame;

a motion detector configured to detect a motion value between a current pixel data of a current frame from the input unit and a delayed pixel data of a delayed frame delayed from the frame delay, by calculating a number of horizontal direction motion pixels of the current pixel data and the delayed pixel data; and a comparator configured to compare the detected motion value with a reference motion value to generate and output one of a first and second logic control signals according to a result of the comparison, said generated and output first logic control signal indicating the pixel data is for a moving image, and the generated and output second logic control signal indicating the pixel data is for a still image, wherein the reference motion value corresponds to four motion pixels, wherein the data selection control unit controls the selection unit to select the overdriving compensation data input from the overdriving compensation unit by the first logic control signal if the motion value is the same as or greater than the reference motion value, wherein the data selection control unit controls the selection unit to select the pixel data input from the input unit by the second logic control signal if the motion value is less than the reference motion value, and wherein the motion detector is disposed directly between an output of the frame delay and an input of the comparator.

2. The liquid crystal display device according to claim 1, wherein the motion detector detects a horizontal motion value of the pixel data input from the input unit.

3. A method for driving a liquid crystal display device, the method comprising:

inputting pixel data;

outputting overdriving compensation data using the input pixel data;

detecting whether the input pixel data is motion image data to select one of the input pixel data and the overdriving compensation pixel data according to a result of the detection; and displaying an image corresponding to the selected pixel data, wherein the detecting of whether the input pixel data is the motion image data comprises:

detecting, via a motion detector, a motion value between a current pixel data of a current frame from an input unit and a delayed pixel data of a delayed frame delayed from a frame delay, the motion value being calculated, via the motion detector, using a number of horizontal direction motion pixels of the current pixel data and the delayed pixel data;

comparing, via a comparator, the detected motion value with a reference motion value to generate and output one of a first and second logic control signals according to a result of the comparison, said generated first logic control signal indicating the pixel data is for a moving image, and the generated and output second logic control signal indicating the pixel data is for a still image;

selecting the overdriving compensation data input from an overdriving compensation unit by the first logic control signal if the motion value is the same as or greater than the reference motion value; and selecting pixel data input from the input unit by the second logic control signal if the motion value is less than the reference motion value, wherein the reference motion value corresponds to four motion pixels, and wherein the motion detector is disposed directly between an output of the frame delay and an input of the comparator.

4. The method according to claim 3, further comprising detecting a horizontal motion value of the input pixel data.

* * * * *